United States Patent [19]

Asay

[11] Patent Number: 4,636,266

[45] Date of Patent: Jan. 13, 1987

[54] REACTOR PIPE TREATMENT

[75] Inventor: Roger H. Asay, Santa Clara, Calif.

[73] Assignee: Radiological & Chemical Technology, Inc., San Jose, Calif.

[21] Appl. No.: 617,635

[22] Filed: Jun. 6, 1984

[51] Int. Cl.[4] ..... C23C 8/14

[52] U.S. Cl. ..... 148/6.35; 376/305

[58] Field of Search ..... 148/6.35; 376/305

[56] References Cited

U.S. PATENT DOCUMENTS

| | | | |
|---|---|---|---|
| 4,141,759 | 2/1979 | Pfisterueister | 148/6.35 |
| 4,153,480 | 5/1979 | Coester | 148/6.35 |
| 4,168,184 | 9/1979 | Hultquist | 148/6.35 |

FOREIGN PATENT DOCUMENTS

| | | | |
|---|---|---|---|
| 2536446 | 2/1977 | Fed. Rep. of Germany | 148/6.35 |
| 0121197 | 9/1980 | Japan | 376/305 |
| 0181873 | 10/1983 | Japan | 148/6.35 |
| 7514304 | 8/1976 | Netherlands | 148/6.35 |

*Primary Examiner*—Sam Silverberg

*Attorney, Agent, or Firm*—Fliesler, Dubb, Meyer and Lovejoy

[57] ABSTRACT

A method is set forth of passivating at least a portion of a surface of a stainless steel member to retard buildup of radioactive materials on such surface portion. The surface portion is preferably polished until it is substantially featureless at 100 times magnification. The polished surface is exposed to a gaseous oxygen source at a temperature of 150° C. to 450° C. for at least about five hours. When a pipe passivated as set forth above is utilized in a water system of a light water nuclear reactor, radioactive buildup on the surface is significantly reduced as compared to pipes which have been passivated by exposure to liquid during the passivating process.

25 Claims, 3 Drawing Figures

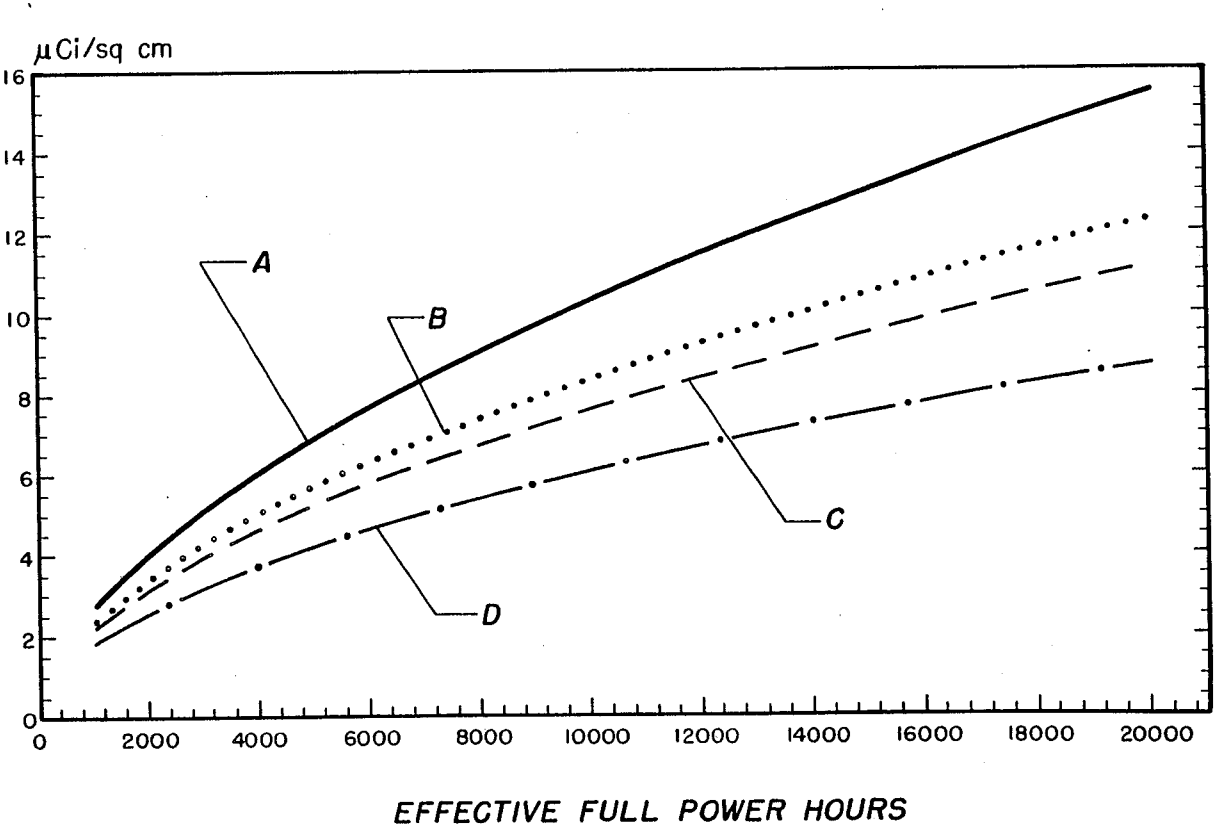
FIGURE 3 PIPE PRECONDITIONING TEST RESULTS
COBALT-60 CONCENTRATION IN CORROSION FILM

REACTOR PIPE TREATMENT

BACKGROUND OF THE INVENTION

1. Technical Field

This invention relates to a method of passivating at least a portion of a surface of a stainless steel member so as to retard the buildup of radioactive material on such a surface portion, and to the use of the passivated member in the water system of a light water type nuclear reactor. More particularly, the invention relates to a method of passivating stainless steel pipe which is utilized in the water system of a light water type nuclear reactor.

2. Background Art

When light water nuclear reactors, which term includes both pressurized water and boiling water reactors, have been in use for some time, radioactive products build up on the inner walls of the piping of the water system. Basically, precursors of radioactive materials such as $Co^{60}$, $Zn^{65}$, $Co^{58}$, are leached from pipes and the radioactive materials are formed from the precursors in the flux zone of the nuclear reactor and then are transferred through the water to other portions of the system where they collect on the inside of the piping. As a result, maintenance personnel who must work on the pipes of the light water system are exposed to the generated radiation field.

One attempt to alleviate the above set out problem has been to shut down the reactor once the radioactivity on the pipes of the reactor have become too radioactive and then to take out these pipes and either decontaminate or (if the structural integrity of the pipe has become inadequate) replace them with new pipes. Unfortunately, the radioactivity level builds up very quickly after such processes since the water is already saturated with dissolved radioactive materials and since such materials can quickly become incorporated into the surfaces of the replacement pipes.

Attempts to solve the latter problem, that of the much faster buildup of radioactive materials on replacement pipes than occur on original or new equipment, have consisted of trying to prepassivate the replacement pipes in a liquid system much like that to which they are to be exposed when installed in the water systems of light water reactors. Unfortunately, the passivation obtained has not been nearly sufficient to stop the rapid buildup of radioactive materials on the surfaces of the decontaminated or replacement pipes. Furthermore, it is relatively expensive to form a closed system to accomplish such passivation as has been attainable in the past.

DISCLOSURE OF THE INVENTION

The present invention is directed to overcoming one or more of the problems as set forth above.

In accordance with an embodiment of the present invention, a method is set forth of passivating at least a portion of a surface of a stainless steel member. The method comprises exposing a portion of the surface to a gaseous oxygen source at a temperature which falls within a range from about 150° C. to about 450° C. for at least about five hours.

In accordance with another embodiment of the present invention, a method is set forth of reducing the rate of buildup of radioactive products on the interiors of the piping of light water nuclear reactors. The method consists of installing and using piping passivated as set forth above in the light water reactor.

When a gas phase passivation process is carried out as set forth above on stainless steel pipes which are used for enclosing the water of a light water reactor, a very effective passivation layer builds up which greatly retards the buildup of radioactive materials on the thus passivated surface. This is true even when the reactor has been in use for some time and the pipes are used as replacements for older pipes which have failed, or have had too much radioactivity buildup on them. The method is relatively insensitive to pressure and to the source of the oxygen whereby its implementation is inexpensive, rapid and relatively straightforward.

BRIEF DESCRIPTION OF DRAWINGS

The invention will be better understood by reference to the figures of the drawings wherein:

FIG. 3 graphically illustrates experimental data which demonstrates the effectiveness of the method of the present invention.

BEST MODE FOR CARRYING OUT THE INVENTION

Figure 1:
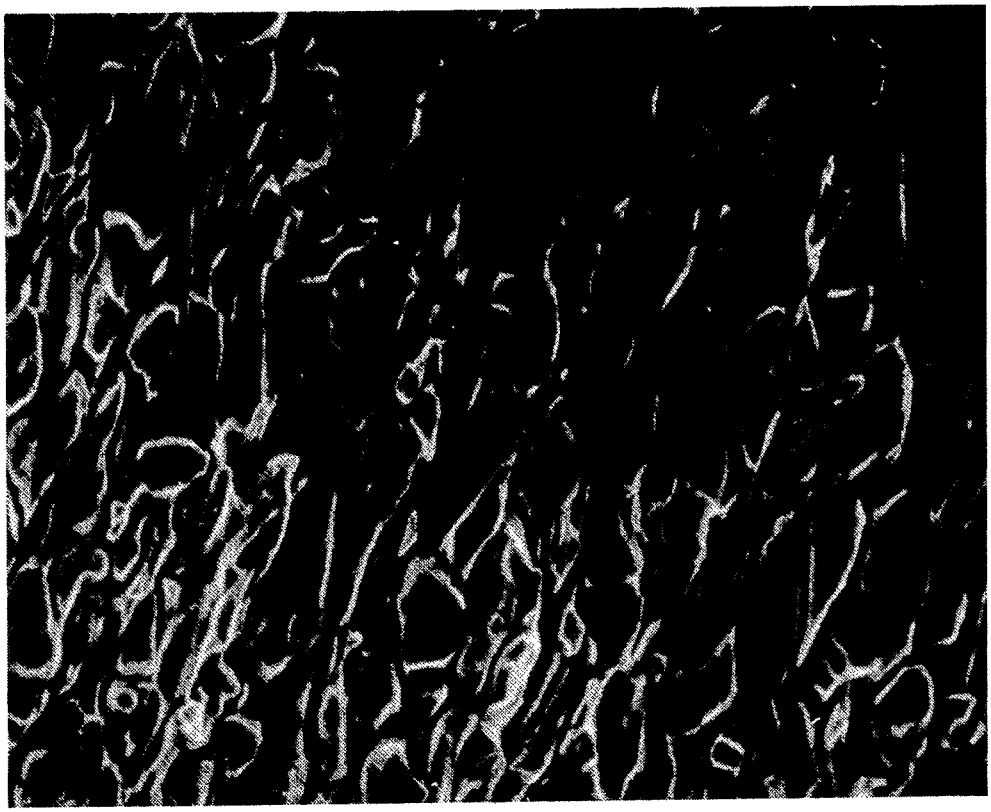
FIG. 1 illustrates a photomicrograph at 500 times magnification of a surface to be treated prior to its being polished.
Figure 2:
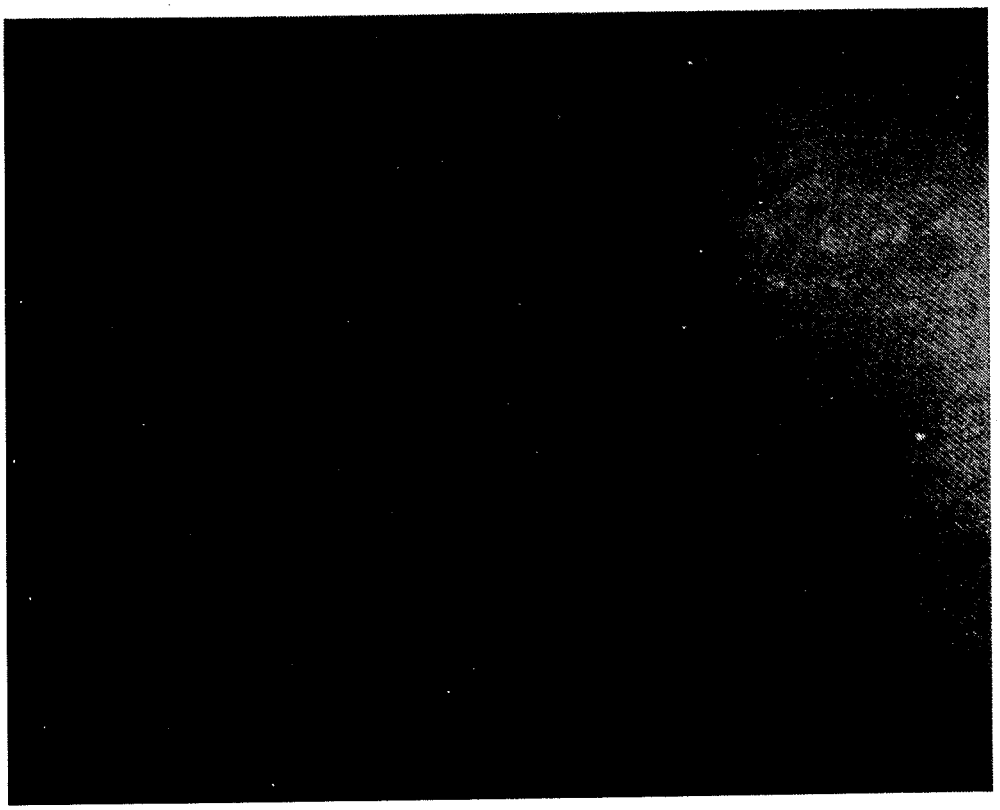
FIG. 2 illustrates a surface as in FIG. 1 and again under 500 times magnification, but following an electropolishing step.

The present invention is concerned with the passivation of stainless steel members, generally pipes, which are used in the water systems of light water nuclear reactors. The first step of the present invention is generally to polish that portion of the surface of a stainless steel pipe which is to be exposed to the water of a boiling water reactor, preferably until the surface is "featureless" as determined at 100 times magnification and, more preferably, at 500 times magnification. Such polishing can be accomplished by conventional electropolishing techniques which are performed after all mill treatments, e.g., annealing, pickling, etc., have been completed. The determination as to whether or not the electropolished surface is "featureless", is normally performed by scanning electron microscopy. FIGS. 1 and 2 show a surface prior to electropolishing and after electropolishing, thus demonstrating, generally, the accepted meaning of the word "featureless" in the electropolishing art.

Following polishing of the surface, that portion of the surface which is to be passivated is exposed to a gaseous oxygen source. The gaseous oxygen source may be oxygen itself, mixtures of oxygen with other gases, e.g., air, steam, inert diluents, and mixtures of the above. It is essential that the oxygen source be in the gas phase and that the exposing step be carried out in the gas phase.

The exposing must take place at a temperature which falls in the range from about 150° C. to 450° C. Preferably, the exposing step will take place at a temperature substantially equal to that of the water temperature within the light water reactor, namely at a temperature of 250° C. to 320° C. Generally, it is desirable that the temperature be at least as high as that to which the pipe is to be subjected when in use.

The time of exposure is not critical but should be at least about five hours. Generally, an exposure time of from about 50 hours to about 300 hours is preferred although longer times can be used.

If the exposure is carried out in a pressure vessel, then the vessel itself should be clean and should be preconditioned at the same conditions under which the pipe is to be exposed within the vessel. If the pipe is passivated in a pressure vessel and if water as well as oxygen is present in the vessel during the passivation step, then it is important that the water fill only the bottom of the pressure vessel and that the pipe be exposed to the vapor phase only.

In one embodiment of the present invention, the passivation can be carried out in the water system of the light water reactor. In such an instance, the system is emptied of water sufficiently so that no liquid water will contact the sections of new piping which are to be passivated. An oxygen source is provided within the system. The system is heated to a sufficiently high temperature as set forth above and maintained in such condition for sufficient time for passivation to occur. Thereafter, the system is filled with water and used.

In accordance with one preferred embodiment of the invention, the exposure of the pipe to the gaseous oxygen source takes place under ambient atmospheric pressure conditions. In such a situation, the oxygen source is generally simply air or air which includes a minor amount of water vapor. This eliminates the necessity for a pressure vessel and for the passivation of such a vessel. In essence, the pipe is heated to the desired temperature and that temperature is maintained for the required period of time. Thereafter, the pipe has been passivated and can be installed in the water system of a light water reactor.

It should be noted that when the surface is polished it is only necessary to polish that surface of the pipe which is to be exposed to the water within the boiling water reactor. That is, only the inner surface of the pipe need be passivated if that is the only surface which is to be exposed to the water system of the boiling water reactor.

FIG. 3 illustrates the effectiveness of the present invention both with and without the use of a polishing step. Curve A illustrates the rate of buildup of radioactivity of a new but untreated (by the method of the invention) pipe when installed in a boiling water type nuclear reactor. Curve B illustrates the effect on rate of buildup of radioactivity of electropolishing an identical pipe but not otherwise treating it. Curve C illustrates the effect on rate of buildup of radioactivity of passivating an identical pipe without prepolishing it. Curve D illustrates the effect on rate of buildup of radioactivity of first electropolishing an identical pipe and then exposing it to a gaseous oxygen source in accordance with the present invention.

The present invention is particularly useful for passivating stainless steel members, more particularly stainless steel pipes. The term stainless steel, when used herein, has its usual accepted meaning, e.g., as set forth in *Standard Handbook for Mechanical Engineers,* 7th Ed., Marks and Baumeister, pp. 6–39. Any of a number of stainless steels may be passivated in this manner. For example, 304 stainless steel, 316 stainless steel, 347 stainless steel can be passivated in this manner.

The invention will be better understood by reference to the following illustrative examples which demonstrate the lack of criticality in selection of oxygen source and in the pressure chosen at which the passivation occurs.

EXAMPLE 1

PASSIVATION IN PRESSURE VESSEL

A clean pressure vessel, namely a type 347 stainless steel autoclave, was preconditioned at the temperatures chosen for the passivating step. Namely, it was preconditioned with deionized water for 72 hours at 285° C.

The vessel was then completely drained and electropolished pipe sections were loaded into it. Demineralized water (pH=7.0, conductivity less than 1 $\mu$S/cm) was added to the bottom of the pressure vessel. The pipe sections of type 316 NG were positioned so as to not be in contact with liquid water.

Ambient air was bubbled through the water in the pressure vessel for two hours to achieve air saturation of the water. During the passivation step a continuous purge of air was maintained through the liquid water phase in the pressure vessel. After air saturation was achieved, the temperature of the pressure vessel was increased from ambient to about 287° C. over a six hour period. The pressure had risen to approximately 6900 kPa. The system was maintained under these conditions for 150 hours. The dissolved oxygen content of the water was checked at least daily to verify that air saturation was maintained throughout the passivation process.

At the conclusion of the passivation process, the temperature of the pressure vessel was decreased to ambient over a nine hour period. The pipe sections were then carefully removed from the pressure vessel, rinsed with demineralized water of the same standard set forth above, and were then air dried. They were then in condition for installation in the water system of a boiling water reactor.

EXAMPLE 2

AMBIENT PRESSURE PASSIVATION

Electropolished pipe of 316NG stainless steel was exposed at ambient pressure to flowing (about 40 cfm) air at approximately 285° C., with injection of steam at a rate of approximately 30 cc/min. This process was carried out for 150 hours. The pipe was rinsed with demineralized water and air dried. Thereafter, it was ready for installation into the water system of a boiling water reactor.

EXAMPLE 3

IN SITU PASSIVATION

Electropolished 316 stainless steel pipe is installed into the water system of a light water reactor after the system is drained sufficiently so that the pipe is not in contact with liquid water. The system is air filled so as to provide the needed oxygen source. The system is then heated to approximately 285° C. and maintained at that temperature for 50 to 300 hours. Thereafter, the light water system is refilled with water and the reactor is again in condition for use.

Industrial Applicability

The present invention provides a unique passivation procedure for passivating the pipes used in the water system of a boiling water reactor so as to very significantly reduce the buildup of radioactive materials on such pipes. The passivation procedure is relatively easy to carry out. Exposure of maintenance personnel to radiation is significantly reduced by utilizing pipe passivated as set forth herein as replacement pipe in water systems of preexisting boiling water nuclear reactors.

While the invention has been described in connection with certain specific embodiments thereof, it is to be understood that such description was for convenience only and that other advantages and objects of the invention will become apparent to one skilled in the art from the foregoing description and the accompanying drawings and that the invention includes such advantages and objects.

I claim:

1. A method of retarding buildup of radioactive materials on a water exposed stainless steel surface of a pipe which forms a part of a water system of a light water nuclear reactor, comprising:

exposing the water exposed surface of the pipe to a gaseous oxygen source which includes oxygen while preventing contact of said water exposed surface with liquid water at a temperature which falls in a range from about 150° C. to no greater than 450° C. for at least about five hours; and using said pipe as a portion of the water system of the light water nuclear reactor.

2. A method as set forth in claim 1, further including, prior to said exposing:

polishing said portion of said surface until it is featureless as determined at 100 times magnification.

3. A method as set forth in claim 2, wherein said exposing step is carried out at substantially ambient atmospheric pressure.

4. A method as set forth in claim 1, further characterized in that said pipe comprises a decontaminated pipe formerly used in said water system.

5. A method as set forth in claim 2, wherein said oxygen source further comprises a minor amount of water vapor.

6. A method as set forth in claim 2, wherein said oxygen source comprises air.

7. A method as set forth in claim 6, wherein said exposing step is carried out at substantially ambient atmospheric pressure.

8. A method as set forth in claim 7, wherein said oxygen source further comprises a minor amount of water vapor.

9. A method as set forth in claim 2, wherein said exposing step is carried out in a pressure vessel.

10. A method as set forth in claim 9, wherein said pressure vessel is preconditioned at a temperature in the range from about 150° C. to about 450° C. prior to said exposing step.

11. A method as set forth in claim 2, wherein said exposing step is carried out at a temperature at least as high as that to which said member is to be subjected when in use.

12. A method as set forth in claim 2, wherein said member comprises a pipe and wherein said surface comprises an inside surface of said pipe.

13. A method as set forth in claim 12, wherein said pipe is installed in a water system of a light water nuclear reactor above a level of water contained therein prior to said exposing step, and wherein said exposing takes place in situ in said water system.

14. A method as set forth in claim 1, wherein said exposing step is carried out at substantially ambient atmospheric pressure.

15. A method as set forth in claim 1, wherein said oxygen source comprises oxygen.

16. A method as set forth in claim 15, wherein said oxygen source further comprises a minor amount of water vapor.

17. A method as set forth in claim 1, wherein said oxygen source comprises air.

18. A method as set forth in claim 17, wherein said exposing step is carried out at substantially ambient atmospheric pressure.

19. A method as set forth in claim 18, wherein said oxygen source further comprises a minor amount of water vapor.

20. A method as set forth in claim 1, wherein said exposing step is carried out in a pressure vessel.

21. A method as set forth in claim 20, wherein said pressure vessel is preconditioned at a temperature in the range from about 150° C. to about 450° C. prior to said exposing step.

22. A method as set forth in claim 1, wherein said exposing step is carried out at a temperature at least as high as that to which said member is to be subjected when in use.

23. A method as set forth in claim 1, wherein said surface comprises an inside surface of said pipe.

24. A method as set forth in claim 23, wherein said pipe is installed in a water system of a light water nuclear reactor above a level of water contained therein prior to said exposing step, and wherein said exposing takes place in situ.

25. A method as set forth in claim 1, wherein said temperature falls in a range from about 250° C. to about 320° C.

* * * * *